US005813961A

United States Patent [19]

Buchwald

[11] Patent Number: 5,813,961

[45] Date of Patent: Sep. 29, 1998

[54] INKING, WATER FORM AND METERING ROLLER

[75] Inventor: Ronald R. Buchwald, Lakeside, Oreg.

[73] Assignee: Diamond Holding Corporation, Marietta, Ga.

[21] Appl. No.: 522,743

[22] Filed: Sep. 1, 1995

[51] Int. Cl.[6] ..... B21B 31/08

[52] U.S. Cl. ..... 492/56; 101/148; 101/348; 29/895.32

[58] Field of Search ..... 492/56, 30, 18; 29/895.32; 101/148, 348, 375, 376

[56] References Cited

U.S. PATENT DOCUMENTS

| | | | |
|---|---|---|---|
| 294,436 | 3/1884 | Bingham | 492/18 |
| 689,590 | 12/1901 | Johnson et al. | 492/18 |
| 710,327 | 9/1902 | Kling | 492/18 |
| 1,370,709 | 3/1921 | Smith . | |
| 2,429,670 | 10/1947 | Crews | 91/67.8 |
| 2,690,119 | 9/1954 | Black | 101/148 |
| 2,741,014 | 4/1956 | Hubbard | 492/56 |
| 3,210,826 | 10/1965 | Connelly | 492/18 |
| 3,377,949 | 4/1968 | Prince | 101/376 |
| 3,625,146 | 12/1971 | Hutchison | 492/56 |
| 4,078,286 | 3/1978 | Takiguichi et al. | 492/56 |
| 4,178,200 | 12/1979 | Hakert et al. | 492/56 |
| 4,195,570 | 4/1980 | Haren | 101/348 |
| 4,750,422 | 6/1988 | Gysin | 101/426 |
| 5,016,530 | 5/1991 | Palmatier | 101/148 |
| 5,257,967 | 11/1993 | Gysin | 492/56 |
| 5,520,600 | 5/1996 | Fukumoto | 492/56 |
| 5,544,584 | 8/1996 | Thompson et al. | 492/56 |
| 5,549,968 | 8/1996 | Byers et al. | 101/376 |
| 5,649,890 | 7/1997 | Lapp et al. | 492/18 |

FOREIGN PATENT DOCUMENTS

79/01078 6/1980 WIPO .

*Primary Examiner*—Larry I. Schwartz
*Assistant Examiner*—Marc W. Butler
*Attorney, Agent, or Firm*—Thomas, Kayden, Horstemeyer & Risley

[57] ABSTRACT

An inking, water form and metering roller (5) having an elongated and generally cylindrical core (7) comprising a first elastomeric material in which a continuous helical groove (12) is defined and extends along the length thereof. The core is fully enclosed in a jacket (18) of a second elastomeric material. Both the core and the jacket of the roller have predetermined durometer hardnesses, the durometer hardness of the jacket being greater than the durometer hardness of the core. An inking, water form and metering roller (35) is also disclosed having an elongated and generally cylindrical core (37) of an elastomeric material with a predetermined durometer hardness in which a continuous helical groove (42) is defined, and in which a separate ribbon (48) of the elastomeric material comprising the core and having the same durometer hardness as the core is helically interwound and finished flush with the exterior surface of the core.

14 Claims, 2 Drawing Sheets

INKING, WATER FORM AND METERING ROLLER

FIELD OF THE INVENTION

This invention relates in general to rollers used in printing presses. More particularly, this invention relates to an improved inking, water form and metering roller to be used in a printing press.

BACKGROUND OF THE INVENTION

Inking, water form or metering rollers are used in the printing industry to spread fluids, including water or ink, over a printing plate as evenly and as thinly as possible in order to allow for the uniform printing of images by the printing plate. When water is distributed over the printing plate, the fluid covers those areas of the plate that bear printing images to which ink is later applied for printing, as well as applying water to those areas that are free of printing images and are intended to be kept free of ink. If water is applied to the printing plate and spread too thickly or too unevenly, printing is adversely affected and the printed image that is produced is often unacceptable. For example, areas with too much water may be starved of ink, thus leading to ghosting in the printed product, in which a portion of the printed image is faded or not printed at all due to a lack of ink. Similarly, water ghosting can also be a problem if water is applied too heavily to one area of the printing plate rather than uniformly applied over the entire printing plate.

One approach to the problem of uniformly distributing a thin coat of fluid across the face of printing plates has been to use a dual durometer roller. In this type of roller, a rubber-like or elastomeric material of a predetermined durometer hardness is formed as a core, and a second rubber-like or elastomeric material having a different durometer hardness is layered or applied over the core. Durometer hardness, as known by those skilled in the art, is a measure of indentation hardness used to determine the relative scale of hardness of rubber, rubber-like, and elastomeric materials.

Rolls of this type, i.e., dual durometer rolls, are well known in the art. Early examples of dual durometer rollers used in the printing industry are found in U.S. Pat. Nos. 2,088,471 to Freedlander, issued Jul. 27, 1937; 2,230,289 to Dodge, issued Feb. 4, 1941; 2,333,800 to Lewis et al., issued Nov. 9, 1943, and 2,741,014 to Hubbard, issued April 10, 1956. More recent examples of printing rollers are found in U.S. Pat. Nos. 4,198,739 to Budinger, et al., issued Apr. 22, 1980; and 5,257,967 issued on Nov. 2, 1993, to Gysin.

Although, and as cited above, a number of different inking and printing rollers have been created to deal with the problems of applying uniform and thin layers of fluid across the surfaces of the rollers in a printing press, to include dampening rollers, chrome rollers, metering rollers, ink distributing and form rollers or cylinders, problems have continued to persist concerning the distribution of fluid evenly across the faces of these rollers. One approach to dealing with this problem is disclosed in U.S. Pat. No. 4,750,422 to Gysin, issued Jun. 14, 1988.

In Gysin, a water form roller is disclosed in which the roller has a circular surface formed by a plurality of helically interwound rubber compounds of different durometers, the rubber compounds being bonded together in a conventional vulcanization process, to form a monolithic roller free of surface separations. By providing helically interwound elastomeric or rubber-like materials of different durometers in the exterior surface of the water form roller, it was found that during the forced flow of the liquid, for example when the water form roller was engaged against the surface of the printing plate, that the portion of the water form roller surface which was of softer durometer tended to yield under the pressure of the liquid against the printing plate and thus formed a duct along which the liquid was helically conducted and deposited on the surface of the printing plate. This allowed water to be spread laterally across the face of the printing plate. Conversely, and at the same time, the helical portion of the water form roller surface that was of harder durometer, and thus less yielding, engaged and pressed against the surface of the printing plate and acted to wipe the deposited liquid so as to thinly and evenly spread it over the surface of the printing plate.

Although the water form roller of Gysin represented an advance in the art, it became apparent over time that even with this roller problems in water forming persisted. For example, as the interwound rubber compounds forming the outer surface of Gysin's water form roller were cleaned with the various solvents used in cleaning the surface of the water form roller, the plasticizer, i.e. the softening compound used to make each of the elastomeric materials flexible, was leached out or dissolved at differing rates dependent on the durometer hardness of the elastomeric material with the result that the rubber compounds became more rigid and changed dimensionally so that stress was created between the elastomeric materials of different durometers, with the result that ridges or corrugations were formed in the surface of the water form roller, leading to unacceptable printing results.

An additional problem with the use of dual durometer rollers in conventional printing operations results from the construction of the rollers themselves and their use with isopropyl alcohol as a wetting agent in the printing process. Isopropyl alcohol was, and still is, used as a wetting agent to form a thin uniform fluid film across the surface of printing plates because dual durometer rollers are not constructed to move water laterally across the face of the printing plate for example, and thus have great difficulty in forming a thin uniform film of water across printing plates. The problem with using isopropyl alcohol as a wetting agent, however, is that isopropyl alcohol is a volatile organic chemical which is extremely flammable, is heavier than air, and thus tends to settle in closed places which can result in increased fire and explosion hazards. This is particularly a problem where isopropyl alcohol has been used as a wetting agent in cold weather environments in that isopropyl alcohol fumes and vapors can settle around space heaters, so that a spark from the space heater may cause an explosion. The use of isopropyl alcohol in industrial processes, to include printing operations, is one of the leading causes of industrial fires in the United States.

None of the prior art known to the inventor discloses or illustrates an inking, water form or metering roller designed and constructed to include the features of a helical distribution roller, namely providing a helical fluid distribution pattern across the surface of printing plates, chrome rollers, dampening rollers, and inking rollers, without having two separate elastomeric materials of differing durometer hardnesses forming a portion of the outer surface of the roller, and in which the roller is provided with a smooth and continuous exterior surface for engagement against the rollers of a printing press. Moreover, the inventor is not aware of a prior art roller with a helical fluid distribution pattern which is adapted to minimize the use of isopropyl alcohol as a wetting agent in the printing process by enhancing the performance of non-alcohol wetting agents, thus reducing the health and safety risks associated with the use of alcohol wetting agents. Thus, the need exists for an improved yet simple inking, water form and metering roller which provides the features of a helically wound water form roller, yet which provides a continuous and smooth exterior surface which will not be subject to shrinkage stress and the formation of surface ridges or corrugations thereon during the service life of the roller.

SUMMARY OF THE INVENTION

The present invention provides an improved inking, water form and metering roller which overcomes some of the design deficiencies of other rollers known in the art by providing one roller designed to incorporate the features, and thus benefits, of a helical or spiral fluid distribution pattern laterally across the face of a second roller without the drawbacks of other rollers in the art.

In its capacity as a water metering/slip/pan or form roller used in continuous motion dampening systems, one of the main benefits of the embodiments of the inking, water form and metering rollers of this invention is to eliminate, or greatly reduce, the use of isopropyl alcohol as a wetting agent formerly relied on in continuous motion dampening systems. The use of alcohol substitutes has reduced the operating window on continuous motion dampeners, with spiral rollers giving the lithographer much greater latitude in operating without alcohol. The embodiments of this roller enhance the performance of alcohol-free wetting agents, thereby permitting offset printers to comply with the safety mandates of the Occupational Safety and Health Administration ("OSHA") specifying the reduction or elimination of isopropyl alcohol in these dampening systems. As continuous motion dampeners comprise the majority of dampeners used on today's lithographic presses, the elimination of isopropyl alcohol as a wetting agent, and the enhancement of non-alcohol wetting agents is of primary importance in the printing industry.

The first embodiment of the improved roller disclosed herein has an elongated and generally cylindrical core, or inner layer, of a first elastomeric material in which a continuous helical groove is defined, the groove extending along the length of the core, with the core fully enclosed by a jacket, or outer layer, of a second elastomeric material. The core of this inking, water form and metering roller has a predetermined durometer hardness, and the jacket enclosing the core of the roller has a second predetermined durometer hardness which differs from the first durometer hardness of the core. The durometer hardness of the jacket will be greater, and thus the jacket will have a more rigid surface, than the durometer hardness of the core.

Due to the grooved construction of the core, a helical spread pattern results from use of this roller, without the stress/separation problems in the exterior surface of the roller as in the prior art roller. In addition, the jacket of this roller encloses the ends of the core to prevent mushrooming or degradation of the core when it is engaged in a pressured relationship on the surface of other rollers used in the printing process.

The invention also provides a method for manufacturing this improved roller, in which the elongated and generally cylindrical core of a first, elastomeric material is formed, the continuous helical groove is defined in the exterior surface of the core, and the core is then fully enclosed in a jacket of a second elastomeric material. Once the core is formed, it is vulcanized. Thereafter, once the core is enclosed by the jacket, the entire core and jacket are vulcanized together to form a monolithic roller.

In a second embodiment of this invention, an inking, water form and metering roller having an elongated and generally cylindrical core comprising a first elastomeric material with a predetermined durometer hardness is provided, a continuous helical groove is defined in the exterior surface of the core and extends along the length of the core, and a ribbon of a second elastomeric material of the same durometer hardness as the core is helically interwound within the groove and is finished flush with the exterior surface of the core, thus overcoming the problem of differing plasticizer loss rates resulting in different shrinkage rates for elastomeric materials of differing durometer hardnesses in the exterior surface of the rollers.

A method is also provided for the construction of this second embodiment of the roller, in which the elongated and generally cylindrical core of a first elastomeric material of a predetermined durometer hardness is formed, a continuous helical groove is formed within the core and extends along the length thereof, and then a second ribbon of a elastomeric material of the same durometer hardness is helically interwound within the groove, whereupon the ribbon and core are finished together so that the ribbon is flush with the exterior sidewall of the core so that the roller has a smooth and uniform exterior diameter. As with the first embodiment of this invention, once the core is formed, it is vulcanized. Afterwards, the core and ribbon are then vulcanized together, the core being vulcanized a second time, to form the core and ribbon into a monolithic roller having the improved performance characteristics of a helically grooved and wound roller without the drawbacks associated with the known helical water form roller.

Thus, it is an object of this invention to provide an improved inking, water form and metering roller which can be used in conventional printing presses.

Another object of the invention is to provide an improved inking, water form and metering roller which works to minimize water ghosting and ink ghosting problems on the chrome rollers and ink rollers, respectively, of a printing press.

Still another object of the invention is to provide an improved design in an inking, water form and metering roller which will enhance distribution of ink on ink distribution rollers used in printing presses.

Yet another object of this invention is to provide an improved inking, water form and metering roller which will enhance the performance of non-alcohol wetting agents, thus reducing the percentages of volatile organic compounds present in printing facilities. It is also an object of the invention to provide an improved inking, water form and metering roller which avoids the problems of shrinkage and surface corrugation or ridging which may occur due to plasticizer loss in elastomeric materials of differing durometer hardnesses in the roller.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 1:
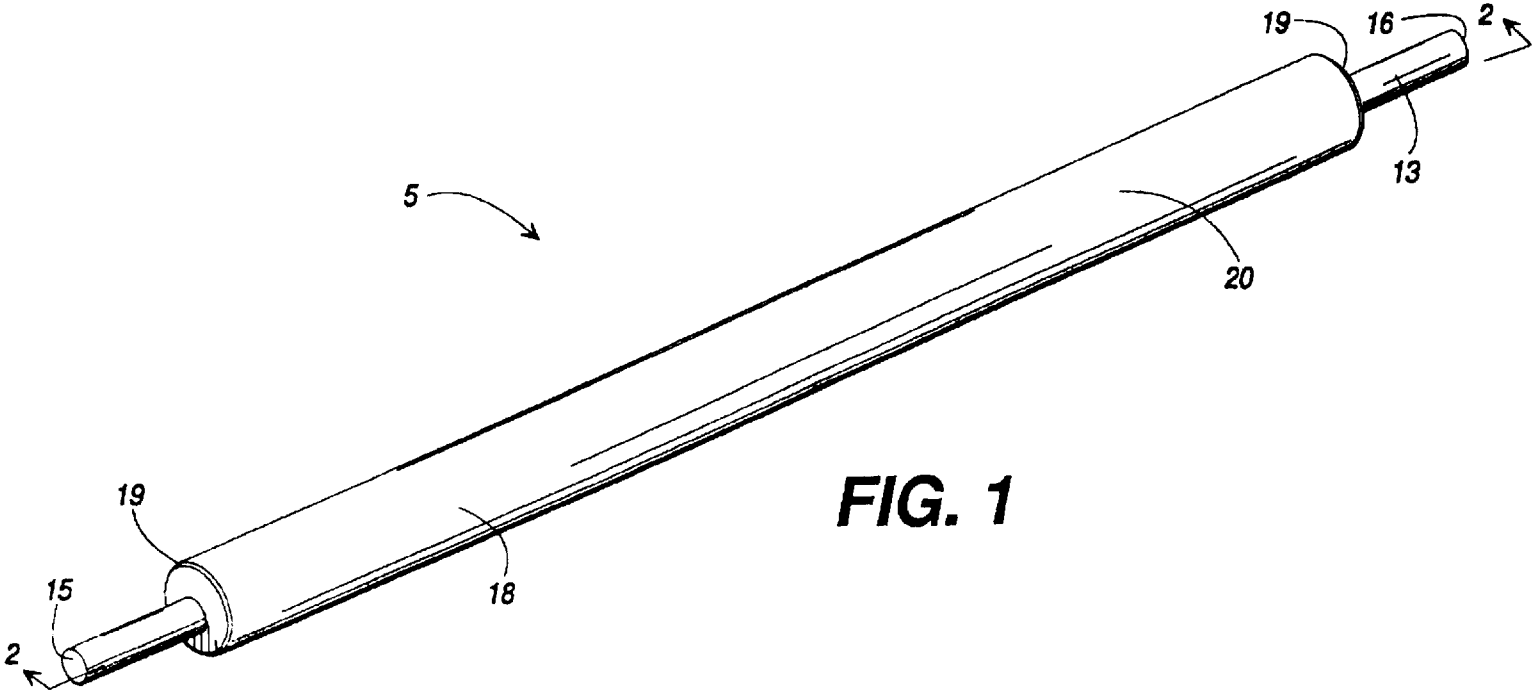
FIG. 1 is a perspective view of a first preferred embodiment of the inking, water form and metering roller of this invention.
Figure 2:
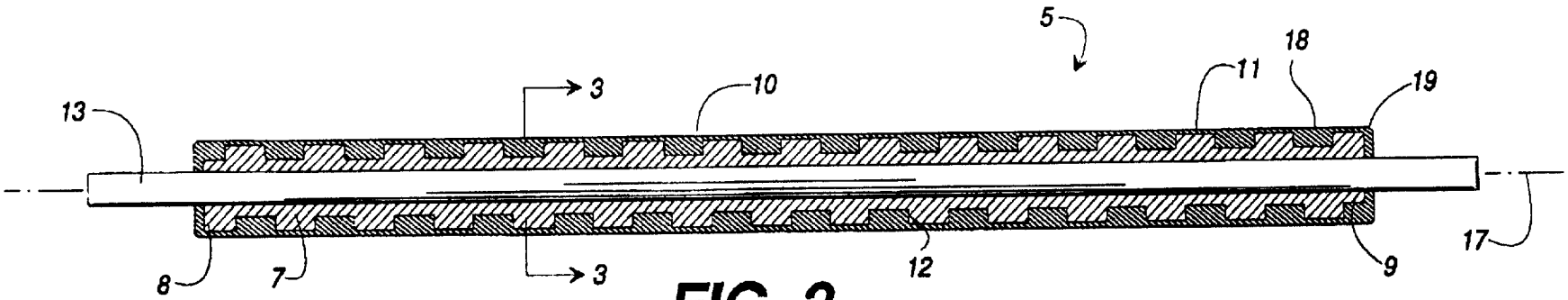
FIG. 2 is a side cross-sectioned elevational view along line 2—2 of FIG. 1.

Referring now in detail to the drawings, in which like reference numerals represent like parts throughout the several views, numeral 5 of FIGS. 1 and 2 illustrate a first preferred embodiment of an inking, water form and metering roller. Although roller 5 is shown in FIGS. 1 and 2 as having a certain length and diameter it is understood by those skilled in the art that various rollers 5 can be constructed of any suitable length and diameter for any one of the printing presses in which roller 5 may be used.

Figure 4:
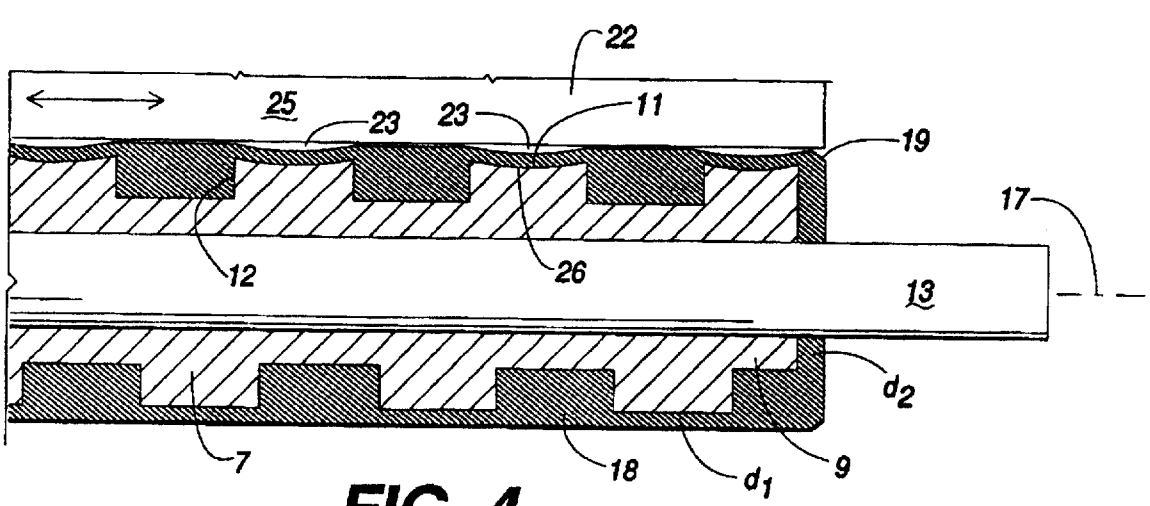
FIG. 4 is a partial cross-sectioned detail view of the surface of the roller of FIG. 1 in use in a printing press.

Referring now to FIG. 2, roller 5 has an elongated and generally cylindrical core 7 having a first end 8 and a spaced second end 9. A continuous sidewall 10 extends between first end 8 and second end 9 along the length of the core. As best shown in FIGS. 2 and 4, core 7 includes a continuous helical groove 12 which is defined in sidewall 10, and extends from first end 8 to second end 9 of the core. As shown in FIG. 2, although core 7 has a continuous sidewall 10, once groove 12 is defined therein, it appears as if sidewall 10 is made of several corrugations or projections 11, rather than being one continuous sidewall.

Roller 5 is formed concentrically about an elongated roller support shaft 13. Roller support shaft 13 has a first end 15 and a spaced second end 16, and extends along a longitudinal axis 17. Core 7 is positioned between first end 15 and second end 16 of shaft 13.

As best shown in FIG. 1, roller 5 includes a jacket 18 which fully encloses core 7 on shaft 13. Jacket 18 is formed concentrically about core 7 and shaft 13, and encloses first end 8, second end 9, sidewall 10, and groove 12 within the jacket. Referring now to FIGS. 2 and 4, each end of jacket 18 has an end bevel 19 formed concentrically about axis 17 of shaft 13, for stress relief purposes and for permitting the passage of water or other fluids, for example ink, past the ends of the roller to prevent excess fluid buildup at the roller's ends.

Figure 3:
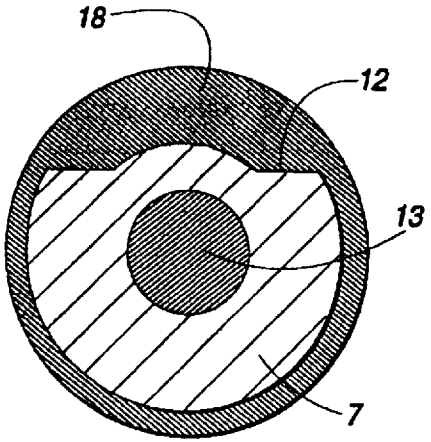
FIG. 3 is a cross-sectioned elevational view along line 3—3 of FIG. 2.

FIGS. 2–4 illustrate the manner in which jacket 18 fills groove 12 of core 7 with an inner continuous helical projection, from first end 8 to second end 9 of the core, and also caps, i.e. covers, first end 8 and second end 9 of core 7 on shaft 13, as discussed above. So constructed, roller 5 will have the performance characteristics and features of a helically interwound or spiral roller having two elastomeric materials of differing hardnesses on its exterior surface, such as that disclosed in U.S. Pat. No. 4,750.422, to Gysin, issued Jun. 14, 1988. However, and unlike the drawbacks of the water form roller to Gysin, water form roller 5 of FIGS. 1–4 has a continuous and smooth exterior surface 20 (FIG. 1), due to the smooth outer surface of the jacket, without any boundary line or joint line formed between two elastomeric materials of differing hardnesses, thus overcoming the problems of differential plasticizer removal with an accompanying loss of material flexibility, thus avoiding the shrinking and cracking which would otherwise follow in the surface of the roller.

Both core 7 and jacket 18 are formed from an elastomeric material selected from among the group of nitrile rubber, nitrile rubber blends, synthetic plastic resins, and synthetic rubber blends commercially available and known to those skilled in the art. Core 7 and jacket 18 can also be formed from an elastomeric porous rubber such as foam rubber or a cast foam rubber, the roam rubbers having a durometer hardness measured on the Shore 00 Hardness Scale, provided the Shore 00 durometer hardnesses are the equivalent of the Shore A durometer hardnesses discussed hereinbelow. It is anticipated here that core 7 and jacket 18 are made of nitrile rubber of differing durometer hardnesses, although any one of the above listed groups of materials will suffice. Roller support shaft 13 is made of conventional materials with its ends 15 and 16 of the shaft being sized and shaped for placement within a conventional support bearing, to include roller bearings, journal bearings, or other bearings used in commercial printing presses for the purpose of rotatably supporting the roller with respect to the other rollers of the printing press.

Both core 7 and jacket 18 have a durometer hardness, which is, as known to those skilled in the art, a standard measure of rubber indentation hardness. The most conventionally known measure of durometer hardness is the Shore A durometer hardness scale, which is used with soft vulcanized rubber and all elastomeric materials, to include natural rubber, GR-S, GR-1, neoprene, nitrile rubbers, Thiokol, flexible polyester cast resins, polyacrylic esters, and so on, as well as also being used for wax, felt, leather, and other materials. Shore A hardness has a scale graduated from 0, no hardness, to 100, no indentation. For example, a Shore A hardness in the range of 50 to 65 is typical for rubber tread compounds used in motor vehicle tires. As discussed herein, all reference to durometer hardnesses refer to the Shore A durometer hardness scale. The standards used in determining Shore A hardness are disclosed in The Standard Test Method designated D 2240-85 published by the American Society for Testing Materials (ASTM).

Core 7 will have a durometer hardness which is less than, i.e. softer, than the durometer hardness of jacket 18. It is anticipated that the durometer hardness of core 7 and jacket 18 may range throughout the Shore A hardness scale dependent upon the performance characteristics desired in roller 5. It is anticipated here, however, that the preferred embodiment will comprise a core 7 having a Shore A durometer hardness of 20 and a jacket 18 having a Shore A durometer hardness of 60.

For jacket 18 to function in a manner similar to a water form roller having an exterior surface formed by helically interwound elastomeric materials of differing hardnesses, it is anticipated that jacket 18 will have a minimum thickness, noted by the designation "$d_1$", ranging from 0.020 inches to 0.187 inches over the projections 11 of sidewall 10 extending radially toward jacket 18, as illustrated in FIGS. 2 and 4. It is anticipated that in order to provide the maximum amount of protection of core 7 with jacket 18, and yet provide the maximum amount of helical performance in laterally transferring water across the face of roller 5 and any rollers against which roller 5 is engaged, that jacket 18 will have a minimum thickness $d_1$ of approximately 0.060" over sidewall 10, particularly over projections 11 thereof, along the length of core 7.

As core 7 is made of a "softer" elastomeric material than is jacket 18, it is possible that first end 8 and second end 9 of core 7 could mushroom or otherwise expand in use longitudinally along axis 17 with respect to the circumference of the core, thus allowing the ends of the roller to collapse with the accompanying loss of ability to control the transfer of fluid across that portion of a roller 22 (FIG. 4) against which roller 5 is engaged, for example. In order to solve this problem, and as described above, first end 8 and second end 9 of core 7 are also enclosed by jacket 18. It is anticipated that jacket 18 will be approximately 0.3125 (5/16) inches thick at each end of core 7, as indicated by the notation "$d_2$" in FIG. 4. It is anticipated that minimum distances $d_1$ and $d_2$ can be varied through routine experimentation in order to enhance the desired performance characteristics of roller 5 when used in a conventional printing press.

Roller 5 of FIGS. 1–4 is shown in operation in FIG. 4. FIG. 4 is a partial detailed side elevational view of roller 5 engaged against a second roller 22, second roller 22 being, for example, a printing plate mounted on a print cylinder. For the purposes of this discussion, roller 22 is separately provided with a thin coat of water from one of a number of dampening rollers (not illustrated) engaged with the surface of roller 22. As roller 22 is rotated roller 5 engages the surface of roller 22, at which point in time, due to its unique construction, roller 5 will act to move a water film 23 laterally across the face of roller 22 as shown by the double-edged arrow in FIG. 4.

As known to those skilled in the art, water is not compressible. Thus, and as shown in FIG. 4, as the water film on the surface of roller 22 is squeezed between roller 22 and the exterior surface 20 of roller 5, jacket 18 is compressed, which in turn tends to compress projections 11 of core 7 to a greater extent than those portions of jacket 18 which have filled groove 12. Since the material of core 7 is softer in relation to the material of jacket 18, here by a factor of approximately 3, the underlying elastomeric material of core 7, projections 11, which extend radially outward toward jacket 18 are compressed radially inward by the water film acting between the exterior surface 25 of roller 22 and the exterior surface 20 of roller 5. However, those portions of jacket 18 which extend into groove 12 defined in the sidewall, being of a material harder than the core and having a thicker cross-section, are less compressible relative to the compressibility of the thinner portion of jacket 18 and projections 11, and thus they act to form ridges to wipe the water laterally moved by the deformed portions 26 of jacket 18 and projections 11. Thus, roller 5 acts as an inking, water form and/or metering roller for providing a thin, uniform even coat of fluid, be it water 23, or ink (not illustrated) laterally across the surface of roller 22.

In effect, due to its unique construction, roller 5 will pump fluid laterally across the surface of the roller, and will wipe the fluid with those more rigid portions of jacket 18 which fill groove 12 of the core. However, and unlike the water form roller of Gysin, discussed above, jacket 18 has a smooth and continuous exterior surface 20 which is not susceptible to shrinkage due to a differential plasticizer loss, because jacket 18 is made of a single elastomeric material of a single predetermined durometer hardness. Additionally, jacket 18 will not hold ink and/or debris to the extent that the roller of Gysin will, and thus less cleaning solvents are required to clean roller 5 after its usage is completed.

Inking, water form and metering roller 5 illustrated in FIGS. 1–4 is constructed in the following fashion. A first elastomeric material selected from one of the elastic materials discussed above, here nitrile rubber, is extruded or otherwise conventionally applied to shaft 13 intermediate first end 15 and second end 16 thereof. This is typically done while shaft 13 is rotated and the extruded elastomeric material forming core 7 is moved along the length of the shaft. Thereafter, once core 7 is formed as a generally elongated cylinder, the core is vulcanized in a conventional vulcanization process, for example a steam vulcanization process, which removes the voids and entrained air within core 7 in order to provide a monolithic core. Thereafter the core will be finished as a generally cylindrical body.

Next, and in conventional fashion, continuous helical groove 12 is cut into the exterior surface of core 7, extending from first end 8 to second end 9 of the core. The depth of groove 12 is controlled during the cutting process so that it will extend to within 1/32 of an inch from roller support shaft 13. In this fashion, a relatively thick coat of a second elastomeric material, again selected from the group of elastomeric materials listed above, and being nitrile rubber in this instance, is applied to core 7 as jacket 18 to fully enclose first end 8, second end 9, and sidewall 10, including all of groove 12 defined in the sidewall of the core. Once jacket 18 is formed in proper size and thickness with respect to core 7, both the core and the jacket are vulcanized in a second conventional vulcanization process to remove the entrained air and voids within jacket 18 and to bond jacket 18 to core 7 to form a monolithic roller. Core 7 and jacket 18 are finished to size in conventional fashion.

Figure 5:
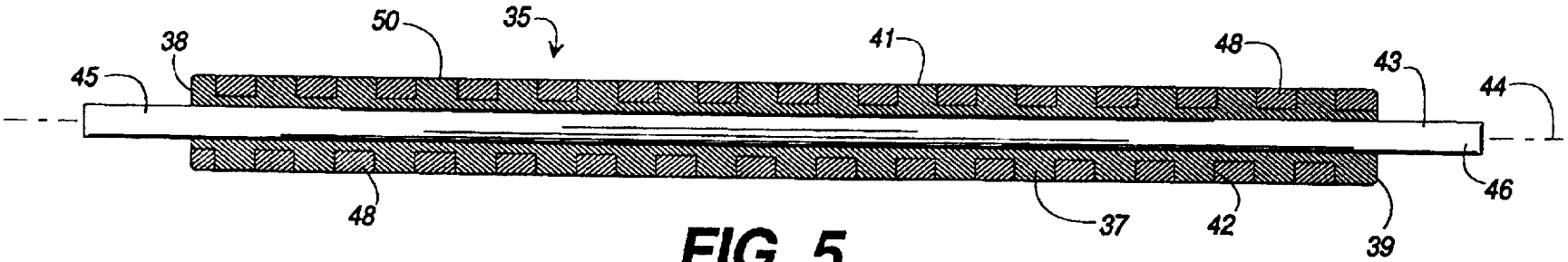
FIG. 5 is a cross-sectioned side elevational view along the length of a second preferred embodiment of the roller of this invention.

Referring now to FIG. 5, a second preferred embodiment of an inking, water form and metering roller is disclosed. Water form and metering roller 35 of FIG. 5 has an elongated and generally cylindrical core 37, having a first end 38 and a spaced second end 39. Core 37 has a sidewall 41 extending from first end 38 to second end 39, in which a continuous helical groove 42 is defined. As with roller 5, roller 35 is concentrically formed about a roller support shaft 43 having a longitudinal axis 44, with first end 45 and spaced second end 46.

However, and unlike roller 5, roller 35 of FIG. 5 does not have a jacket which fully encloses core 37, rather a ribbon of elastomeric material 48 fills groove 42, ribbon 48 being finished flush with the exterior surface/sidewall 41 of roller 35. Both core 37 and ribbon 48 of roller 35 have an identical or substantially similar durometer hardness, and ribbon 48 is finished flush with sidewall 41 of the core. In the prior art, a roller such as roller 35 would have been provided with, and it was anticipated it could only have been provided with, two elastomeric materials of differing hardnesses so that ribbon 48 would be harder or softer than sidewall 41 of the core. Here, however, core 37 and ribbon 48 of roller 35 each have an identical durometer hardness (Shore A) when constructed. The durometer hardness for the core and ribbon is 20, although the range of durometer hardnesses for the materials may vary throughout the scale dependent on the desired performance characteristics of the roll. Core 37 and ribbon 48 are also manufactured of the same elastomeric material, although they may each be constructed of separate elastomeric materials so long as the durometer hardness of the materials is the same.

Roller 35 is manufactured in a fashion similar to roller 5. An extruded elastomeric material selected from the group of materials consisting of nitrile rubber, a nitrile rubber blend, a synthetic plastic resin, a synthetic rubber blend, a foam rubber, or a cast foam rubber, here nitrile rubber, is extruded or otherwise wound about and along shaft 43 intermediate its first end 45 and second end 46. Thereafter, core 37 is cured through a conventional vulcanization process and finished, after which continuous helical groove 42 is cut to within 1/32 of an inch from support shaft 45 in sidewall 41, groove 42 extending from first end 38 to second end 39 of the core. Thereafter, and unlike roller 5, ribbon 48, a second elastomeric material, again selected from the group of materials listed above, here nitrile rubber, is helically interwound with core 37 within groove 42, filling the groove. Both core 37 and ribbon 48 are then vulcanized, core 37 being vulcanized a second time, and thus the exposed exterior surfaces of sidewall 41 are vulcanized a second time enhancing the surface characteristics of the roller, and forming a monolithic roller from core 37 and ribbon 48. The roller is then finished with a smooth exterior surface 50.

It has been found, unexpectedly, that when ribbon 48 has the same durometer hardness as core 37, that the surface properties of core 37, i.e. those portions of sidewall 41 left exposed and forming exterior surface 50 of roller 35, in conjunction with ribbon 48, act in ridge-like fashion so that ribbon 48 will deflect under pressure much in fashion similar to the deflection of jacket 18 (FIG. 4) so that a fluid, be it water or ink, is laterally moved across the surface of a roller (not illustrated) on which roller 35 is engaged. Those portions of sidewall 41 which form exterior surface 50 act to wipe the surface of the printing plate or other roller (not illustrated) to ensure that a thin and uniform coat of fluid is spread across the face thereof.

Since core 37 and ribbon 48 are formed from either a common elastomeric material or differing elastomeric materials, of the same durometer hardness, the same amount of plasticizing agent will have been used and is present within each of the elastomeric materials, and thus the plasticizer is dissolved or leached out by cleaning agents at a uniform rate, and thus the shrinkage and surface ridging or corrugation problems which existed in the prior art helically interwound water form roller do not occur in this roller, thus providing a unique advance in the art.

Lastly, and as with roller 5, although roller 35 is shown in FIG. 5 as having a certain length and diameter, various rollers 35 may be constructed of any suitable length and diameter for any one of the printing presses in which roller 35 will be use.

As a result of the construction of both rollers 5 and 35, each roller can be used in a much broader range of applications than either a conventional inking roller or a water forming or metering roller would be used. For example each of rollers 5 and 35 can be used as a metering roller, a pan roller, a slip roller, or as a water fountain roller in a continuous motion dampening system printing press. In addition, each roller can function as a water form roller to minimize water ghosting, as an ink form roller to overcome ink starvation or ghosting problems, and as ink distribution rollers to enhance ink oscillation on the printing cylinder, thereby improving ink distribution, and providing a better quality printed product as a result of the printing operation.

Accordingly, rather than having to purchase and stock rollers of several different types and manufacture, printing press operators need only have a number of rollers 5 and/or 35 on hand to perform the functions of the myriad number of rollers previously needed. In addition, and as discussed above, due to the unique construction and performance characteristics of these two rollers, the rollers are not apt to experience the surface ridging and corrugation problems encountered in rollers having materials of differing durometer hardnesses in the exterior surface thereof. Also, rollers 5 and 35 enhance the performance of non-alcohol wetting agents, thus mitigating the safety, health, and environmental hazards which might otherwise occur when using the rollers known in the art with alcohol wetting agents.

While preferred embodiments of the invention have been disclosed in the foregoing specification, it is understood by those skilled in the art that variations and modifications thereof can be made without departing from the spirit and scope of the invention, as set forth in the following claims. Also, the corresponding structures, materials, acts and equivalents of means or step plus function elements in the claims below are intended to include any structure, material, or acts for performing the functions in combination with other claimed elements as specifically claimed.

I claim:

1. An inking, water form and metering roller, comprising:

an elongated and generally cylindrical core composed of a first elastomeric material having a first durometer hardness, said core having a first end and a second end, a continuous sidewall extending from said first end to said second end, and a continuous helical groove defined in said sidewall and extending from said first end to said second end; and a jacket composed of a second elastomeric material having a second durometer hardness, wherein said second durometer hardness is different from said first durometer hardness, said jacket fully enclosing said ends and said sidewall of said core, said jacket including an inner within said continuous helical projection that fits within said continuous helical groove of said core and a continuous smooth outer surface, such that said roller has a substantially smooth cylindrical exterior surface.

2. The roller of claim 1, wherein said second durometer hardness is greater than said first durometer hardness.

3. The roller of claim 2, wherein said first durometer hardness is approximately 20 and said second durometer hardness is approximately 60.

4. The roller of claim 1, wherein said jacket has a minimum thickness enclosing the sidewall of said core in the range of from 0.020 inches to 0.187 inches.

5. The roller of claim 4, wherein said minimum thickness is approximately 0.060 inches.

6. The roller of claim 1, wherein said jacket has a thickness of approximately 0.3125 inches enclosing each of the ends of said core.

7. The roller of claim 1, wherein said first elastomeric material and said second elastomeric material are each separately selected from one of the group of materials consisting of nitrile rubber, a nitrile rubber blend, a synthetic plastic resin, and a synthetic rubber blend.

8. The roller of claim 1, further comprising an elongated roller support shaft, said core being formed concentrically about said shaft.

9. The roller of claim 1, wherein said core and said jacket are vulcanized and bonded to one another so that said roller is formed as a monolithic structure.

10. A water form and metering roller, comprising:

an elongated and generally cylindrical core composed of an elastomeric material having a predetermined durometer hardness, said core having a first end and a second end, and a continuous outer sidewall extending from said first end to said second end;

a continuous helical groove defined in said sidewall and extending from said first end to said second end; and a ribbon composed of the same elastomeric material of which said core is composed, this elastomeric material having the same durometer hardness of said elastomeric material of said core, said ribbon being helically interwound within said groove and finished flush with said sidewall along the length of said core;

wherein said core and ribbon interact during usage to form a ridge therebetween which facilitates lateral movement of fluid evenly across said roller; and wherein said durometer hardness of said core and ribbon promotes consistent wear characteristics between said core and ribbon to enhance the useful life of said roller.

11. The roller of claim 10, wherein said core and said ribbon are vulcanized and bonded to one another so that said roller is formed as a monolithic structure.

12. The roller of claim 10, wherein said predetermined durometer hardness is 20.

13. The roller of claim 10, further comprising an elongated roller support shaft, said core being formed concentrically about said shaft.

14. The roller of claim 10, wherein said first elastomeric material and said second elastomeric material are each separately selected from one of the group of materials consisting of nitrile rubber, a nitrile rubber blend, a synthetic plastic resin, and a synthetic rubber blend.

* * * * *